US010074339B2

(12) United States Patent
Higashino

(10) Patent No.: US 10,074,339 B2
(45) Date of Patent: Sep. 11, 2018

(54) RECEIVER CIRCUIT AND OPERATING METHOD OF THE SAME

(71) Applicant: Synaptics Japan GK, Tokyo (JP)

(72) Inventor: Hirofumi Higashino, Nara (JP)

(73) Assignee: Synaptics Japan GK, Tokyo (JP)

( * ) Notice: Subject to any disclaimer, the term of this patent is extended or adjusted under 35 U.S.C. 154(b) by 515 days.

(21) Appl. No.: 14/656,824

(22) Filed: Mar. 13, 2015

(65) Prior Publication Data

US 2015/0262547 A1 Sep. 17, 2015

(30) Foreign Application Priority Data

Mar. 14, 2014 (JP) ..... 2014-052582

(51) Int. Cl.
*G09G 5/00* (2006.01)

(52) U.S. Cl.
CPC ..... *G09G 5/006* (2013.01); *G09G 2310/0278* (2013.01); *G09G 2330/021* (2013.01); *G09G 2330/12* (2013.01)

(58) Field of Classification Search
CPC ..... G09G 5/006; G09G 2310/0278; G09G 2330/021; G09G 2330/12
See application file for complete search history.

(56) References Cited

U.S. PATENT DOCUMENTS

| | | | | |
|---|---|---|---|---|
| 9,094,246 | B1 * | 7/2015 | Chi | H04L 25/0292 |
| 2006/0146043 | A1 | 7/2006 | Tseng | |
| 2012/0182273 | A1 | 7/2012 | Ninomiya et al. | |
| 2015/0130822 | A1 * | 5/2015 | Lee | G09G 3/20 345/520 |

FOREIGN PATENT DOCUMENTS

| | | | |
|---|---|---|---|
| CN | 101101742 | A | 1/2008 |
| CN | 103443843 | A | 12/2013 |
| TW | 201229881 | A | 7/2012 |

* cited by examiner

*Primary Examiner* — Ariel Balaoing
(74) *Attorney, Agent, or Firm* — Patterson + Sheridan, LLP

(57) ABSTRACT

A receiver circuit includes a CLK_LP circuit, a CLK_HS circuit, a DATA_LP circuit, a DATA_HS circuit and a malfunction detection circuit. The CLK_LP circuit and the CLK_HS circuit are connected to the clock lane. The DATA_LP circuit and the DATA_HS circuit are connected to the data lane. The malfunction detection circuit is configured to assert an HS-mode return signal when a first mode signal indicating the communication mode of the clock lane is set to the LP mode at a moment when the second mode signal indicating the communication mode of the data lane is switched from the HS mode to the LP mode. The CLK_LP circuit sets the first mode signal to the HS mode in response to the assertion of the HS-mode return signal.

14 Claims, 11 Drawing Sheets

RECEIVER CIRCUIT AND OPERATING METHOD OF THE SAME

CROSS REFERENCE

This application claims priority of Japanese Patent Application No. 2014-052582, filed on Mar. 14, 2014, the disclosure which is incorporated herein by reference.

TECHNICAL FIELD

The present invention relates to a receiver circuit, a display panel driver and a display device, more particularly, to a receiver circuit configuration suitable for communications in accordance with MIPI-DSI (mobile industry processor interface-display serial interface).

BACKGROUND ART

The MIPI-DSI standard, which is a serial interface standard standardized by the MIPI alliance for communications between a processor and a peripheral device (e.g. a display device) in a portable device, has a feature of high-speed communication with low power consumption.

In data communications in accordance with the MIPI-DSI standard, one clock lane and one to four data lanes are used. Each lane includes two signal lines (a pair of signal lines) which transmit a differential signal. In detail, the clock lane includes two signal lines (a pair of signal lines) which transmits a differential clock signal and each data lane includes two signal lines which transmits a differential data signal.

The MIPI-DSI standard prescribes two communication modes: the LP (low power) mode and the HS (high speed) mode. The LP mode is a communication mode for performing communications at low speed but with low power consumption, and the HS mode is a communication mode for achieving high-speed communications. Transitions between the LP and HS modes in each of the clock lane and the data lanes are achieved by switching the voltage levels on the two signal lines of each of the clock lane and the data lanes in predetermined sequences by the transmitting side. The receiving-side circuit recognizes a transition of the communication mode on the basis of the voltage levels on the two signal lines of each of the clock lane and the data lanes.

A receiving-side circuit may incorrectly determine that the data communication is switched from the HS mode to the LP mode, when noise is applied to the clock lane while a data communication is performed in the HS mode. This may cause an undesired halt of the data communication in the HS mode. It would be desirable to suppress such an undesired influence of noise.

It should be noted that communications in accordance with the MIPI-DSI standard in a liquid crystal display device is disclosed in, for example, Japanese Patent Application Publication No. 2012-150152 A.

SUMMARY OF INVENTION

Therefore, an objective of the present invention is to provide a receiver circuit, display panel driver and display device configured to suppress an undesired influence of noise on data communications.

Other objectives and features of the present invention will be understood from the disclosure of the specification and drawings.

In an aspect of the present invention, a receiver circuit includes a mode detection circuit, a clock generator circuit, a first reception circuit, a second reception circuit, and a malfunction detection circuit. The mode detection circuit detects a transition of a communication mode of a clock lane from a clock signal received from the clock lane to generate a first mode signal indicating the communication mode of the clock lane. The clock generator circuit is configured to generate an internal clock signal which is synchronous with the clock signal when the first mode signal is set to a state corresponding to a first communication mode and to halt the generation of the internal clock signal when the first mode signal is set to a state corresponding to a second communication mode. The first reception circuit is configured to detect a transition of a communication mode of a data lane from a data signal received from the data lane, to generate a second mode signal indicating the communication mode of the data lane, and to generate a first reception data signal corresponding to data transmitted with the data signal when the second mode signal is set to a state corresponding to the second communication mode. The second reception circuit is configured to, when the second mode signal is set to a state corresponding to the first communication mode, identify data transmitted with the data signal by latching the data signal in synchronization with the internal clock signal and to generate a second reception data signal corresponding to the identified data. The malfunction detection circuit is configured to assert a first communication mode return signal when the first mode signal is set to the state corresponding to the second communication mode at a moment when the second mode signal is switched from the state corresponding to the first communication mode to the state corresponding to the second communication mode. The mode detection circuit sets the first mode signal to the state corresponding to the first communication mode in response to the assertion of the first communication mode return signal.

In another aspect of the present invention, a receiver circuit to be used on a receiving side of a communication in accordance with the MIPI-DSI standard is provided. The receiver circuit includes a CLK_LP circuit, a CLK_HS circuit, a DATA_LP circuit, a DATA_HS circuit and a malfunction detection circuit. The CLK_LP circuit detects a transition of a communication mode of a clock lane from voltage levels on two signal lines of the clock lane to generate a first mode signal indicating the communication mode of the clock lane. The CLK_HS circuit is configured to generate an internal clock signal which is synchronous with a differential clock signal received from the clock lane when the first mode signal is set to a state corresponding to an HS "high speed" mode, and to halt the generation of the internal clock signal when the first mode signal is set to a state corresponding to the LP "low power" mode. The DATA_LP circuit is configured to detect a transition of a communication mode of a data lane from voltage levels on two signal lines of the data lane, to generate a second mode signal indicating the communication mode of the data lane, and to generate a first reception data signal corresponding to data transmitted with a differential data signal received from the data lane when the second mode signal is set to a state corresponding to the LP mode. The DATA_HS circuit is configured to, when the second mode signal is set to a state corresponding to the HS mode, identify data transmitted with the differential data signal by latching the differential data signal in synchronization with the internal clock signal and to generate a second reception data signal corresponding to the data transmitted with the differential data signal. The malfunction detection circuit is configured to assert an HS-mode return signal when the first mode signal is set to the state corresponding to the LP mode at a moment when the second mode signal is switched from the state corresponding to the HS mode to the state corresponding to the LP mode. The CLK_LP circuit sets the first mode signal to the state corresponding to the HS mode in response to the assertion of the HS-mode return signal.

In one example embodiment, the receiver circuit thus configured is used in a display panel driver driving a display panel in a display device.

In still another aspect of the present invention, a method of operating a receiver circuit includes: detecting a transition of a communication mode of a clock lane from a clock signal received from the clock lane to generate a first mode signal indicating the communication mode of the clock lane; starting a generation of a first internal clock signal which is synchronous with the clock signal when the first mode signal is set to a state corresponding to a first communication mode; halting the generation of the first internal clock signal when the first mode signal is set to a state corresponding to a second communication mode; detecting a transition of a communication mode of a data lane from a data signal received from the data lane to generate a second mode signal indicating the communication mode of the data lane; performing a clock recovery on the data signal to generate an second internal clock signal when the second mode signal is set to a state corresponding to the second communication mode; identifying data transmitted with the data signal by latching the data signal in synchronization with the second internal clock when the second mode signal is set to the state corresponding to the second communication mode; identifying data transmitted with the data signal by latching the data signal in synchronization with the first internal clock signal, when the second mode signal is set to a state corresponding to the first communication mode; generating a reception data signal corresponding to the identified data; and placing the first mode signal into the state corresponding to the first communication mode, in a case when the first mode signal is set to the state corresponding to the second communication mode at a moment when the second mode signal is switched from the state corresponding to the first communication mode to the state corresponding to the second communication mode.

In still another aspect of the present invention, a method of operating a receiver circuit to be used on a receiving side of a communication in accordance with the MIPI-DSI standard is provided. The method includes: detecting a transition of a communication mode of a clock lane from voltage levels on two signal lines of the clock lane to generate a first mode signal indicating the communication mode of the clock lane; starting generation of a first internal clock signal which is synchronous with a differential clock signal received from the clock lane when the first mode signal is set to a state corresponding to an HS "high speed" mode; halting the generation of the first internal clock signal when the first mode signal is set to a state corresponding to the LP "low power" mode; detecting a transition of a communication mode of a data lane from voltage levels on two signal lines of the data lane, to generate a second mode signal indicating the communication mode of the data lane; performing a clock recovery on a differential data signal received from the data lane to generate a second internal clock signal, when the second mode signal is set to a state corresponding to the LP mode; identifying data transmitted with the differential data signal by latching the differential data signal in synchronization with the second internal clock signal, when the second mode signal is set to the state corresponding to the LP mode; identifying data transmitted with the differential data signal by latching the differential data signal in synchronization with the first internal clock signal, when the second mode signal is set to the state corresponding to the HS mode; generating a reception data signal corresponding to the identified data; and placing the first mode signal into the state corresponding to the HS mode, in a case when the first mode signal is set to the state corresponding to the LP mode at a moment when the second mode signal is switched from the state corresponding to the HS mode to the state corresponding to the LP mode.

The present invention provides a receiver circuit, display panel driver and display device configured to suppress an undesired influence of noise on data communications.

BRIEF DESCRIPTION OF THE DRAWINGS

The above and other advantages and features of the present invention will be more apparent from the following description taken in conjunction with the accompanied drawings, in which.

DESCRIPTION OF PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

In the following, a description is first given of communications in accordance with the MIPI-DSI standard and a receiver circuit used therefor, for easy understanding of the technical concept of the present invention.

Figure 1A:
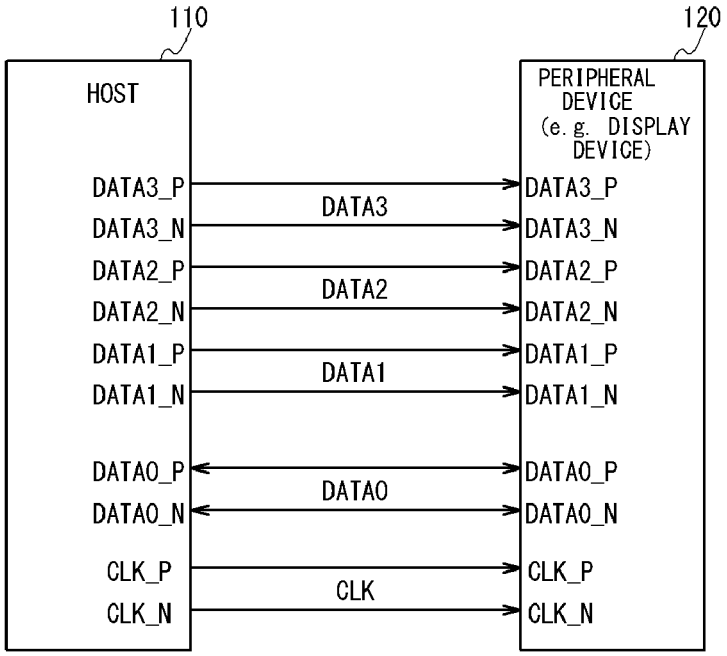
FIG. 1A is a block diagram illustrating one example of a system which achieves communications in accordance with the MIPI-DSI standard.

FIG. 1A is a block diagram illustrating one example of a system which performs communications in accordance with the MIPI-DSI standard. In the system illustrated in FIG. 1A, a host 110 and a peripheral device 120 communicate with each other in accordance with the MIPI-DSI standard. In communications in accordance with the MIPI-DSI standard, one clock lane and one to four data lanes are used. Illustrated in FIG. 1A is the system configuration in the case when the system includes four data lanes. It should be noted that the number of the data lanes may be one to three. In FIG. 1A, symbol "CLK" denotes the clock lane and symbols "DATA0", "DATA1", "DATA2" and "DATA3" respectively denote data lanes 0 to 3.

The clock lane is used to transmit clock signals CLK_P and CLK_N from the host 110 (that is, the transmitting side) to the peripheral device 120 (that is, the receiving side). The clock signals CLK_P and CLK_N are a pair of signals which form a differential clock signal.

Data lanes 0 to 3 are each used to transmit a differential data signal between the host 110 (the transmitting side) to the peripheral device 120 (the receiving side). In detail, data lane 0 transmits data signals DATA0_P and DATA0_N and data lane 1 transmits data signals DATA1_P and DATA1_N, where the data signals DATA0_P and DATA0_N are a pair of signals which form a differential signal and the data signals DATA1_P and DATA1_N are another pair of signals which form a differential signal. Correspondingly, data lane 2 transmits data signals DATA2_P and DATA2_N and data lane 3 transmits data signals DATA3_P and DATA3_N, where the data signals DATA2_P and DATA2_N are still another pair of signals which form a differential signal and the data signals DATA3_P and DATA3_N are still another pair of signals which form a differential signal.

It should be noted that the MIPI-DSI standard prescribes that the system is allowed to use data lane 0 for bidirectional communications in the LP mode. In order to depict this, the two signal lines of data lane 0 are illustrated as lines with arrow heads on the both ends.

As described above, the MIPI-DSI standard prescribes two communication modes: the HS (high speed) mode and the LP (low power) mode. The HS mode is a first communication mode for high-speed data communications and the LP mode is a second communication mode for low-speed data communications with low power consumption.

In the communications in the LP mode, a clock signal is embedded in the data signals DATAi_P and DATAi_N in each data lane i. The peripheral device 120 performs a clock recovery on the data signals and latches the data signals DATAi_P and DATAi_N in synchronization with an internal clock signal obtained by the clock recovery to identify data transmitted with the data signals DATAi_P and DATAi_N. In the data communications in the LP mode, the data signals DATAi_P and DATAi_N have a large amplitude and a low frequency (compared with signals transmitted in the HS mode, as described later).

In the data communications in the HS mode, on the other hand, the data signals DATAi_P and DATAi_N of each data lane i are latched in synchronization with the clock signals CLK_P and CLK_N supplied via the clock lane. In the data communications in the HS mode, the clock signals CLK_P and CLK_N and the data signals DATAi_P and DATAi_N have a smaller amplitude and a higher frequency, compared with the data signals DATAi_P and DATAi_N transmitted in the LP mode.

Transitions between the LP mode and HS mode are individually performed in each of the clock lane and data lanes 0 to 3. It should be noted that the MIPI-DSI prescribes that the data lanes 0 to 3 are allowed to be switched from the HS mode to the LP mode with the clock lane kept in the HS mode in the normal operation, as described later.

A transition of the clock lane from the LP mode to the HS mode or from the HS mode to the LP mode is achieved by switching the voltage levels on the two signal lines of the clock lane in a specific sequence by the host 110. When detecting that the voltage levels on the two signal lines of the clock lane are switched in a specific sequence, the peripheral device recognizes that the communication mode of the clock lane is switched from the LP mode to the HS mode or from the HS mode to the LP mode.

Similarly, a transition of each data lane i from the LP mode to the HS mode or from the HS mode to the LP mode is achieved by switching the voltage levels on the two signal lines of the data lane i in specific sequences by the host 110. When detecting that the voltage levels on the two signal lines of the data lane i are switched in a specific sequence, the peripheral device recognizes that the communication mode of the data lane i is switched from the LP mode to the HS mode or from the HS mode to the LP mode.

Figure 1B:
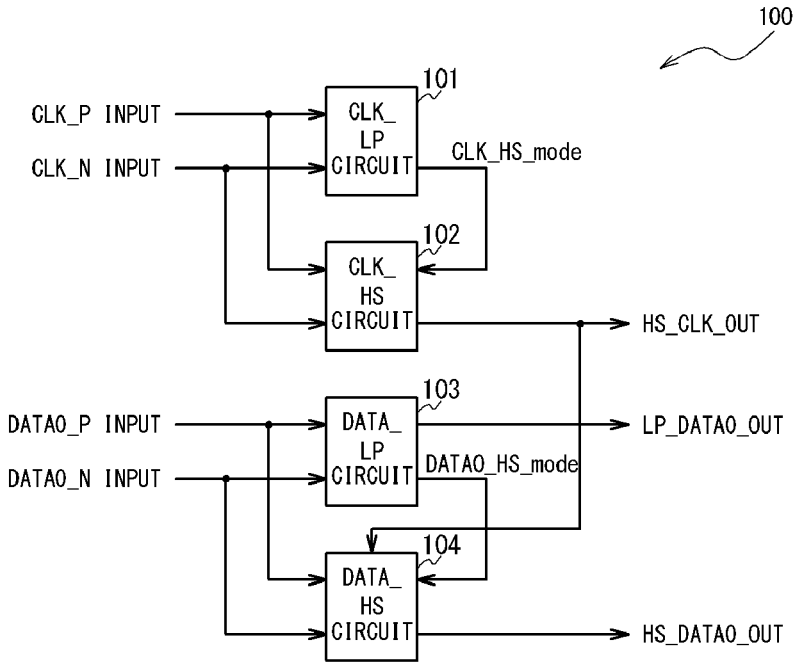
FIG. 1B is a block diagram illustrating one example of the configuration of a receiver circuit.

FIG. 1B is a block diagram illustrating one example of the configuration of a receiver circuit 100 used in the above-described peripheral device 120 (that is, the receiving side). In the following, the configuration and operation of the receiver circuit 100 are described with regard to a single data lane (i.e., data line 0) for easy understanding of the receiver circuit 100. It should be noted, however, that more than one data lane (such as two to four data lanes) may be included in an actual implementation. It should be also noted that the below-described disclosure related to the FIG. 1B must not be construed to mean that the Applicant admits that the configuration of the receiver circuit 100 illustrated in FIG. 1B is known in the art.

The receiver circuit 100 in FIG. 1B includes a CLK_LP circuit 101, a CLK_HS circuit 102, a DATA_LP circuit 103 and a DATA_HS circuit 104.

The CLK_LP circuit 101 operates as a mode detection circuit configured to monitor the clock signals CLK_P and CLK_N (that is, the voltage levels on the two signal lines of the clock lane) to detect transitions of the communication mode of the clock lane. More specifically, when detecting transitions of the voltage levels on the two signal lines of the clock lane in a specific sequence, the CLK_LP circuit 101 recognizes that the communication mode of the clock lane is switched from the LP mode to the HS mode or from the HS mode to the LP mode. When detecting that the communication mode of the clock lane is switched to the HS mode, the CLK_LP circuit 101 asserts an HS mode signal CLK_HS mode, that is, places the HS mode signal CLK_HS mode into the state corresponding to the HS mode. When detecting that the communication mode of the clock lane is switched to the LP mode, on the other hand, the CLK_LP circuit 101 negates the HS mode signal CLK_HS_mode, that is, places the HS mode signal CLK_HS_mode into the state corresponding to the LP mode. As described later, the HS mode signal CLK_HS_mode is a signal used to activate the CLK_HS circuit 102.

The CLK_HS circuit 102 operates as a clock generator circuit configured to generate a clock signal HS_CLK_OUT in synchronization with the clock signals CLK_P and CLK_N, when the clock lane is set to the HS mode. As described later, the clock signal HS_CLK_OUT is an internal clock signal used for data reception when data lane 0 is set to the HS mode. More specifically, when the HS mode signal CLK_HS_mode received from the CLK_LP circuit 101 is asserted, the CLK_HS circuit 102 generates the clock signal HS_CLK_OUT so that the clock signal HS_CLK_OUT is synchronous with the clock signals CLK_P and CLK_N. When the HS mode signal CLK_HS_mode is negated, the CLK_HS circuit 102 is deactivated, not outputting the clock signal HS_CLK_OUT.

The DATA_LP circuit 103 is a reception circuit which receives data over data lane 0 when data lane 0 is set to the LP mode. When data lane 0 is set to the LP mode, the DATA_LP circuit 103 performs a clock recovery on the data signals DATA0_P and DATA0_N to generate an internal clock signal. The DATA_LP circuit 103 latches the data signals DATA0_P and DATA0_N in synchronization with the internal clock signal to identify data transmitted with the data signals DATA0_P and DATA0_N, and generates a reception data signal LP_DATA0_OUT which indicates the identified data. The reception data signal LP_DATA0_OUT is a signal which indicates data transmitted over data lane 0 when data lane 0 is set to the LP mode.

The DATA_LP circuit 103 also has the function of monitoring the data signals DATA0_P and DATA0_N (that is, monitoring the voltage levels on the two signal lines of data lane 0) to detect transitions of the communication mode of data lane 0. When detecting a transition of the voltage levels on the two signal lines of the clock lane in a specific sequence, the DATA_LP circuit 103 recognizes that the communication mode of data lane 0 is switched from the LP mode to the HS mode or from the HS mode to the LP mode. When detecting that the communication mode of data lane 0 is switched to the HS mode, the DATA_LP circuit 103 asserts an HS mode signal DATA0_HS_mode, that is, places the HS mode signal CLK_HS_mode into the state corresponding to the HS mode. When detecting that the communication mode of data lane 0 is switched to the LP mode, on the other hand, the DATA_LP circuit 103 negates the HS mode signal DATA0_HS_mode, that is, places the HS mode signal DATA0_HS_mode into the state corresponding to the LP mode. As described later, the HS mode signal DATA0_HS_mode is a signal used to activate the DATA_HS circuit 104.

It should be noted that, when bidirectional communications are performed over data lane 0 in the LP mode, the DATA_LP circuit 103 is configured not only to receive the data signals DATA0_P and DATA0_N over data lane 0 in the LP mode, but also to transmit a differential data signal over data lane 0 in the LP mode.

The DATA_HS circuit 104 is a reception circuit which receives data over data lane 0 when data lane 0 is set to the HS mode. More specifically, the DATA_HS circuit 104 is activated when data lane 0 is set to the HS mode, that is, when the HS mode signal DATA0_HS_mode is asserted. When being activated, the DATA_HS circuit 104 latches the data signals DATA0_P and DATA0_N in synchronization with the clock signal HS_CLK_OUT received from the CLK_HS circuit 102 to identify data transmitted with the data signals DATA0_P and DATA0_N, and generates a reception data signal HS_DATA0_OUT which indicates the identified data. The reception data signal HS_DATA0_OUT is a signal which indicates data transmitted over data lane 0 when data lane 0 is set to the HS mode. When the HS mode signal DATA0_HS_mode is negated, the DATA_HS circuit 104 is deactivated.

Figure 2:
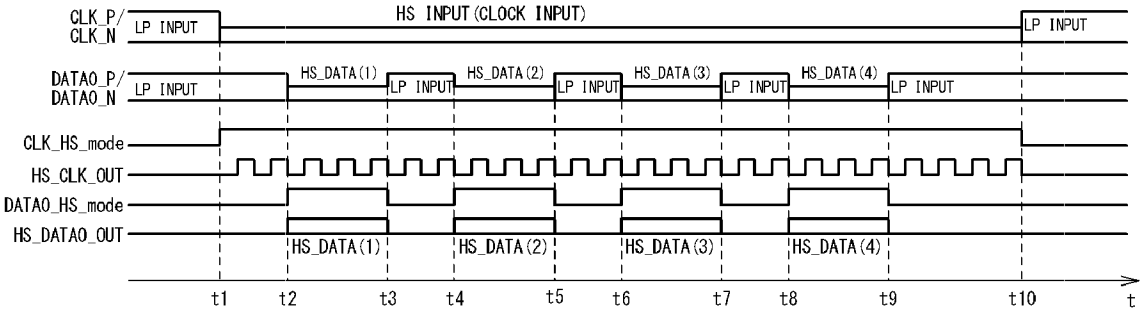
FIG. 2 is a timing chart illustrating an example of the operation of the receiver circuit configured as illustrated in FIG. 1B.

FIG. 2 is a timing chart illustrating an example of the operation of the receiver circuit 100 configured as illustrated in FIG. 1B. In the initial state (at time t<t1), both of the clock lane and data lane 0 is set to the LP mode. This state allows performing a data communication over data lane 0 in the LP mode.

To initiate a data communication over data lane 0 in the HS mode, an HS-mode transition command is transmitted over the clock lane with the clock signals CLK_P and CLK_N at time t1. In other words, the voltage levels on the two signal lines of the clock lane are switched in a specific sequence corresponding to the HS-mode transition command at time t1. When detecting from the voltage levels on the two signal lines of the clock lane that the HS-mode transition command is transmitted over the clock lane, the CLK_LP circuit 101 asserts the HS mode signal CLK_HS mode to activate the CLK_HS circuit 102. When being activated, the CLK_HS circuit 102 start generating the clock signal HS_CLK_OUT in synchronization with the clock signals CLK_P and CLK_N.

This is followed by transmitting an HS-mode transition command over data lane 0 with the data signals DATA0_P and DATA0_N at time t2. When detecting from the data signals DATA0_P and DATA0_N that the HS-mode transition command is transmitted over data lane 0, the DATA_LP circuit 103 asserts the HS mode signal DATA0_HS_mode to activate the DATA_HS circuit 104. When being activated, the DATA_HS circuit 104 latches the data signals DATA0_P and DATA0_N in synchronization with the clock signal HS_CLK_OUT to generate the reception data signal HS_DATA0_OUT.

After a data message with a desired data length is transmitted over data lane 0, an LP-mode transition command is transmitted over data lane 0 with the data signals DATA0_P and DATA0_N at time t3. This completes the transmission of the first data message HS_DATA(1).

When a data communication in the HS mode is subsequently performed, the clock lane is kept in the HS mode, that is, the CLK_HS circuit 102 continues to generate the clock signal HS_CLK_OUT in synchronization with the clock signals CLK_P and CLK_N. In FIG. 2, although the data transmission of the data message HS_DATA(1) is completed at time t3, the clock lane is kept in the HS mode to achieve transmissions of the following data messages HS_DATA(2) to HS_DATA(4).

A desired number of data messages are transmitted in the similar manner from time t4 to time t9. Illustrated in FIG. 2 is the operation in which four data messages HS_DATA(1) to HS_DATA(4) are transmitted.

After the transmission of all of the data messages is completed, an LP-mode transition command is transmitted over data lane 0 with the data signals DATA0_P and DATA0_N at time t9. When detecting that the LP-mode transition command is transmitted over data lane 0, the DATA_LP circuit 103 negates the HS mode signal DATA0_HS_mode.

This is followed by transmitting an LP-mode transmission command over the clock lane with the clock signals CLK_P and CLK_N at time t10. When detecting from the voltage levels on the two signal lines of the clock lane that the LP-mode transition command is transmitted over the clock lane, the CLK_LP circuit 101 negates the HS mode signal CLK_HS_mode at time t10. This allows switching data lane 0 and the clock lane to the LP mode, completing the data communications in the HS mode.

It should be noted that the CLK_LP circuit 101 detects the transition of the clock lane from the HS mode to the LP mode by monitoring the signal levels of the clock signals CLK_P and CLK_N transmitted over the clock lane (that is, the voltage levels on the two signal lines of the clock lane).

This suggests that there is a possibility that the CLK_LP circuit 101 incorrectly determines that the clock lane is switched from the HS mode to the LP mode. As described below, when the CLK_LP circuit 101 incorrectly determines that the clock lane is switched from the HS mode to the LP mode, this may cause a malfunction in which the data communication in the HS mode is not completed successfully, since the generation of the clock signal HS_CLK_OUT, which is used for the data communication over data lane 0 in the HS mode, is stopped.

Figure 3:
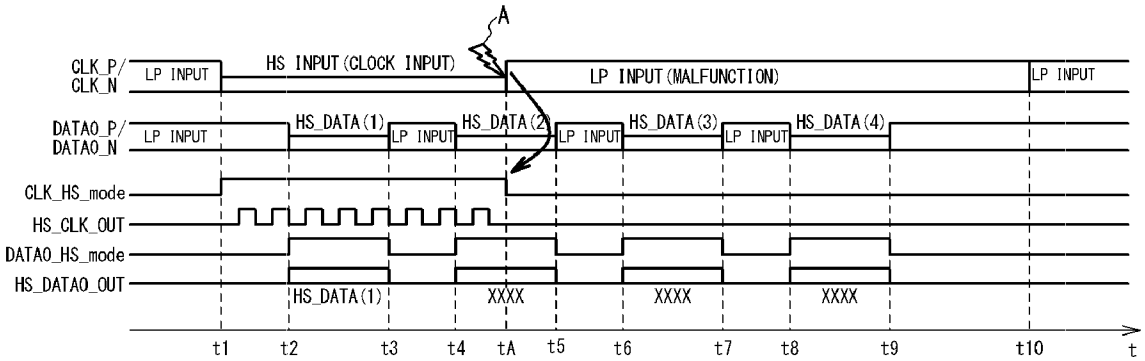
FIG. 3 is a timing chart illustrating the operation of the receiver circuit in the case when the clock lane is incorrectly determined as being switched from the HS mode to the LP mode due to noise applied to the clock lane.

FIG. 3 is a timing chart illustrating the operation of the receiver circuit 10 in the case when the CLK_LP circuit 101 incorrectly determines at time tA, which is between time t4 and time t5, in the operation illustrated in FIG. 2 that the clock lane is switched from the HS mode to the LP mode as a result of noise A applied at time tA.

When incorrectly determining that the clock lane is switched from the HS mode to the LP mode at time tA due to the noise A, the CLK_LP circuit 101 negates the HS mode signal CLK_HS_mode. In response to the negation of the HS mode signal CLK_HS_mode, the CLK_HS circuit 102 halts the generation of the clock signal HS_CLK_OUT. After the halt of the generation of the clock signal HS_CLK_OUT, The DATA_HS circuit 104 cannot receive data transmitted with the data signals DATA0_P and DATA0_N. Accordingly, the data message HS_DATA(2) is not successfully received.

It should be noted here that, although noise A is applied when the data message HS_DATA(2) is being transmitted, in the operation illustrated in FIG. 3, the data messages HS_DATA(3) and HS_DATA(4), which are to be transmitted subsequently to the data message HS_DATA(2), are also unsuccessfully received. This results from the halt of the generation of the clock signal HS_CLK_OUT. This suggests that the operation illustrated in FIG. 2 suffers from increased data loss when noise is applied to the clock lane.

Receiver circuits according to the present embodiment, which are described below in detail, are configured to reduce influences of the above-described malfunction resulting from noise applied to the clock lane. In the following, a description is given of details of exemplary configurations and operations of receiver circuits according to the present embodiment.

Figure 4:
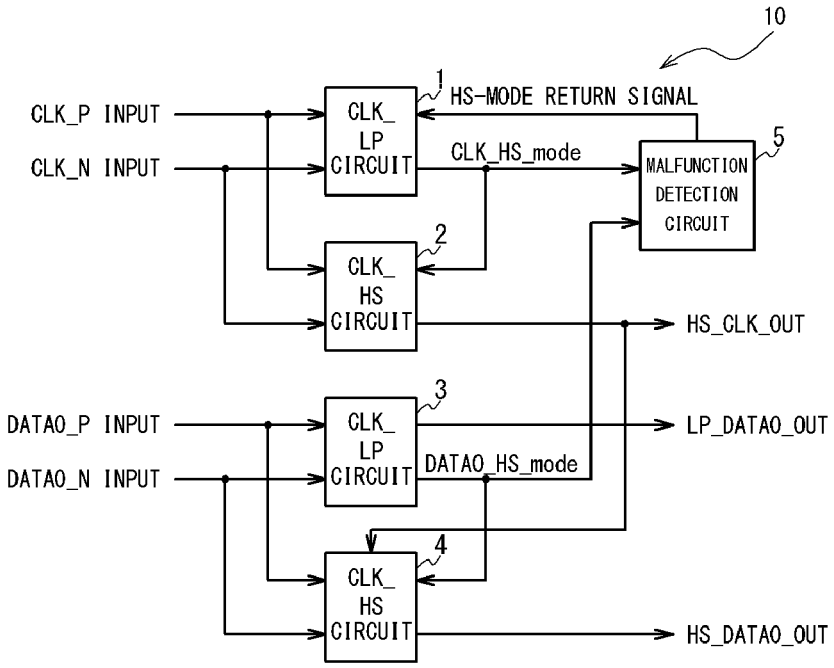
FIG. 4 is a block diagram illustrating an exemplary configuration of a receiver circuit in one embodiment of the present invention.

FIG. 4 is a block diagram illustrating an exemplary configuration of a receiver circuit 10 in one embodiment of the present invention. The receiver circuit 10 in the present embodiment is preferably used on the receiving side of communications in accordance with the MIPI-DSI standard; in one embodiment, the receiver circuit 10 may be used in the peripheral device 120 in the system illustrated in FIG. 1A.

In one embodiment, the receiver circuit 10 includes a CLK_LP circuit 1, a CLK_HS circuit 2, a DATA_LP circuit 3, a DATA_HS circuit 4 and a malfunction detection circuit 5. The configuration of the receiver circuit 10 illustrated in FIG. 4 is adapted to data communications over one clock lane and one data lane (that is, data lane 0); the configuration of the receiver circuit with a plurality of data lanes is described later. The CLK_LP circuit 1 and the CLK_HS circuit 2 are each connected to two signal lines of the clock lane. The DATA_LP circuit 3 and the DATA_HS circuit 4 are each connected to two signal lines of data lane 0.

The CLK_LP circuit 1 operates as a mode detection circuit configured to monitor the clock signals CLK_P and CLK_N (that is, the voltage levels on the two signal lines of the clock lane) to detect transitions of the communication mode of the clock lane. More specifically, when detecting that a HS-mode transition command is transmitted with the clock signals CLK_P and CLK_N, that is, when detecting that the voltage levels of the two signals of the clock lane are switched in the sequence corresponding to the HS-mode transition command, the CLK_LP circuit 1 asserts an HS mode signal CLK_HS_mode, that is, places the HS mode signal CLK_HS_mode into the state corresponding to the HS mode. The HS mode signal CLK_HS_mode is used to activate the CLK_HS circuit 2. When detecting that an LP-mode transition command is transmitted with the clock signals CLK_P and CLK_N, that is, the voltage levels on the two signal lines of the clock lane are switched in the sequence corresponding to the LP-mode transition command, the CLK_LP circuit 1 negates the HS mode signal CLK_HS_mode, that is, places the HS mode signal CLK_HS_mode into the state corresponding to the LP mode.

The CLK_HS circuit 2 operates as a clock generator circuit configured to generate a clock signal HS_CLK_OUT in synchronization with the clock signals CLK_P and CLK_N, when the clock lane is set to the HS mode. As described later, the clock signal HS_CLK_OUT is an internal clock signal used for data reception when data lane 0 is set to the HS mode. More specifically, when the HS mode signal CLK_HS_mode is asserted, the CLK_HS circuit 2 generates the clock signal HS_CLK_OUT so that the clock signal HS_CLK_OUT is synchronous with the clock signals CLK_P and CLK_N. When the HS mode signal CLK_HS_mode is negated, the CLK_HS circuit 2 is deactivated, not outputting the clock signal HS_CLK_OUT.

The DATA_LP circuit 3 is a first reception circuit which receives data over data lane 0 when data lane 0 is set to the LP mode. When data lane 0 is set to the LP mode, the DATA_LP circuit 3 performs a clock recovery on the data signals DATA0_P and DATA0_N to generate an internal clock signal. The DATA_LP circuit 3 latches the data signals DATA0_P and DATA0_N in synchronization with the internal clock signal to identify data transmitted with the data signals DATA0_P and DATA0_N, and generates a reception data signal LP_DATA0_OUT which indicates the identified data. The reception data signal LP_DATA0_OUT is a signal which indicates data transmitted over data lane 0 when data lane 0 is set to the LP mode.

The DATA_LP circuit 3 also has the function of monitoring the data signals DATA0_P and DATA0_N (that is, the voltage levels on the two signal lines of data lane 0) to detect transitions of the communication mode of data lane 0. When detecting that an HS-mode transition command is transmitted with the data signals DATA0_P and DATA0_N, (that is, the voltage levels on the two signal lines of data lane 0 are switched in the sequence corresponding to the HS-mode transition command), the DATA_LP circuit 3 asserts an HS mode signal DATA0_HS_mode, that is, places the HS mode signal CLK_HS_mode into the state corresponding to the HS mode. The HS mode signal DATA0_HS_mode is used to activate the DATA_HS circuit 4. When detecting that an LP-mode transition command is transmitted with the data signals DATA0_P and DATA0_N (that is, the voltage levels on the two signal lines of data lane 0 are switched in the sequence corresponding to the LP-mode transition command), the DATA_LP circuit 3 negates the HS mode signal DATA0_HS_mode, that is, places the HS mode signal DATA0_HS_mode into the state corresponding to the LP mode.

It should be noted that, when bidirectional communications are performed over data lane 0 in the LP mode, the DATA_LP circuit 3 is configured not only to receive the data signals DATA0_P and DATA0_N over data lane 0 in the LP mode, but also to transmit a differential data signal over data lane 0 in the LP mode.

The DATA_HS circuit 4 is a second reception circuit which receives data over data lane 0 when data lane 0 is set to the HS mode. More specifically, when data lane 0 is set to the HS mode, that is, when the HS mode signal DATA0_HS_mode is asserted, the DATA_HS circuit 4 is activated, and latches the data signals DATA0_P and DATA0_N in synchronization with the clock signal HS_CLK_OUT received from the CLK_HS circuit 2, to identify data transmitted with the data signals DATA0_P and DATA0_N. The DATA_HS circuit 4 generates a reception data signal HS_DATA0_OUT corresponding to the identified data. The reception data signal HS_DATA0_OUT is a signal corresponding to data transmitted over data lane 0 when data lane 0 is set to the HS mode. When the HS mode signal DATA0_HS_mode is negated, the DATA_HS circuit 4 is deactivated.

The malfunction detection circuit 5 generates an HS-mode return signal in response to the HS mode signal CLK_HS_mode received from the CLK_LP circuit 1 and the HS mode signal DATA0_HS_mode received from the DATA_LP circuit 3. The HS-mode return signal is a signal which instructs the CLK_LP circuit 1 and the CLK_HS circuit 2 to operate in the HS mode.

The malfunction detection circuit 5 is configured to detect occurrence of a malfunction caused by noise applied to the clock lane (see noise A of FIG. 3). When detecting a malfunction caused by noise applied to the clock lane, in which the CLK_LP circuit 1 and the CLK_HS circuit 2 are switched to the state in which the CLK_LP circuit 1 and the CLK_HS circuit 2 operate in the LP mode, the malfunction detection circuit 5 asserts the HS-mode return signal. When the HS-mode return signal is asserted, the CLK_LP circuit 1 unconditionally asserts the HS mode signal CLK_HS_mode to activate the CLK_HS circuit 2. The CLK_HS circuit 2 starts generating the clock signal HS_CLK_OUT in response to the assertion of the HS mode signal CLK_HS_mode. This successfully allows the receiver circuit 10 to return to the normal operation.

In the present embodiment, the detection of occurrence of a malfunction by the malfunction detection circuit 5 is based on the fact that, in the normal operation in accordance with the MIPI-DSI standard, the clock lane should be placed in the HS mode when a data lane is switched to the LP mode.

As illustrated in FIG. 2, for example, the data lane is switched to the LP mode after the data communications over the data lane in the HS mode is completed, in the normal operation in accordance with the MIPI-DSI standard; the clock lane should be kept in the HS mode to continue the generation of the clock signal HS_CLK_OUT, at the moment when the data lane is switched to the LP mode. In other words, in the normal operation in accordance with the MIPI-DSI standard, the HS mode signal CLK_HS_mode should be asserted at the moment when the HS mode signal DATA0_HS_mode is negated.

When the clock lane is incorrectly determined as having been switched to the LP mode due to noise as illustrated in FIG. 3, the CLK_LP circuit 1 and the CLK_HS circuit 2 operates in the LP mode at the moment when the HS mode signal DATA0_HS_mode is negated after the completion of the data communication over data lane 0 in the HS mode (note that the data communication are actually unsuccessfully completed due to the lack of the clock signal HS_CLK_OUT). In other words, at the moment when the HS mode signal DATA0_HS_mode is negated, the HS mode signal CLK_HS_mode is also negated. Accordingly, the fact that the HS mode signal CLK_HS_mode is negated at the moment when the HS mode signal DATA0_HS_mode is negated provides a basis for determining that the clock lane is being wrongly recognized as having been switched to the LP mode.

In such a case, the malfunction detection circuit 5 asserts the HS-mode return signal fed to the CLK_LP circuit 1 to allow the CLK_LP circuit 1 and the CLK_HS circuit 2 to return the state in which the CLK_LP circuit 1 and the CLK_HS circuit 2 operate in the HS mode. More specifically, the malfunction detection circuit 5 determines the voltage level of the HS mode signal CLK_HS_mode in response to the negation of the HS mode signal DATA0_HS_mode. When the HS mode signal CLK_HS_mode is negated at the moment when the HS mode signal DATA0_HS_mode is negated, the malfunction detection circuit asserts the HS-mode return signal. In response to the assertion of the HS-mode return signal, the HS mode signal CLK_HS_mode is asserted by the CLK_LP circuit 1 as described above, and this allows restarting the generation of the clock signal HS_CLK_OUT by the CLK_HS circuit 2. Since the CLK_LP circuit 1 and the CLK_HS circuit 2 return to the state in which the CLK_LP circuit 1 and the CLK_HS circuit 2 operates in the HS mode, data lane 0 becomes ready to perform data communications in the HS mode.

Figure 5:
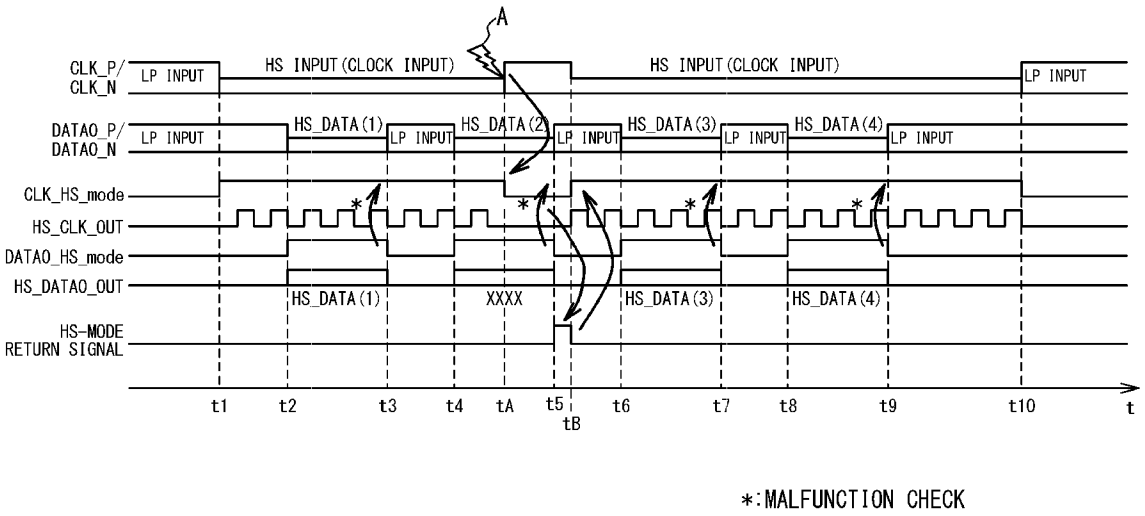
FIG. 5 is a timing chart illustrating an exemplary operation of the receiver circuit of the present embodiment.

FIG. 5 is a timing chart illustrating an exemplary operation of the receiver circuit 10 illustrated in FIG. 4, especially an exemplary operation of the malfunction detection circuit 5, in the case when the clock lane is incorrectly determined to have been switched to the LP mode due to noise applied to the clock lane. In the initial state (time t<t1), the clock lane and data lane 0 are both set to the LP mode. This state allows performing data communications over data lane 0 in the LP mode. To initiate a data communication over data lane 0 in the HS mode, an HS-mode transition command is transmitted over the clock lane with the clock signals CLK_P and CLK_N at time t1. In other words, the voltage levels on the two signal lines of the clock lane are switched in a specific sequence corresponding to the HS-mode transition command at time t1. When detecting from the voltage levels on the two signal lines of the clock lane that the HS-mode transition command is transmitted over the clock lane, the CLK_LP circuit 1 asserts the HS mode signal CLK_HS_mode to activate the CLK_HS circuit 2. When being activated, the CLK_HS circuit 2 start generating the clock signal HS_CLK_OUT in synchronization with the clock signals CLK_P and CLK_N.

Subsequently, transmission of the first data message HS_DATA(1) is started at time t2. More specifically, an HS-mode transition command is transmitted over data lane 0 with the data signals DATA0_P and DATA0_N at time t2. When detecting from the data signals DATA0_P and DATA0_N that the HS-mode transition command is transmitted over data lane 0, the DATA_LP circuit 3 asserts the HS mode signal DATA0_HS_mode to activate the DATA_HS circuit 4. When being activated, the DATA_HS circuit 4 latches the data signals DATA0_P and DATA0_N in synchronization with the clock signal HS_CLK_OUT to generate the reception data signal HS_DATA0_OUT. The reception data signal HS_DATA0_OUT is thus generated to indicate the data message HS_DATA(1).

When the transmission of the data message HS_DATA(1) over data lane 0 is completed, an LP-mode transition command is transmitted over data lane 0 with the data signals DATA0_P and DATA0_N at time t3. When detecting the LP-mode transmission command in the data signals DATA0_P and DATA0_N, the DATA_LP circuit 3 negates the HS mode signal DATA0_HS_mode to switch data lane 0 to the LP mode. This completes the transmission of the first data message HS_DATA(1).

Meanwhile, the malfunction detection circuit 5 determines the voltage level of the HS mode signal CLK_HS_mode in response to the negation of the HS mode signal DATA0_HS_mode. In FIG. 5, the symbol "*" indicates the operation of checking the voltage level of the HS mode signal CLK_HS_mode. Since the HS mode signal CLK_HS_ mode is asserted at time t3 (that is, the CLK_LP circuit 1 and the CLK_HS circuit 2 operate in the HS mode at time t3), the malfunction detection circuit 5 determines that no malfunction occurs, not asserting the HS-mode return signal.

This is followed by starting transmission of the second data message HS_DATA(2) at time t4. More specifically, when detecting from the data signals DATA0_P and DATA0_N that an HS-mode transition command is transmitted over data lane 0, the DATA_LP circuit 3 asserts the HS mode signal DATA0_HS_mode to activate the DATA_HS circuit 4. When being activated, the DATA_HS circuit 4 latches the data signals DATA0_P and DATA0_N in synchronization with the clock signal HS_CLK_OUT to generate the reception data signal HS_DATA0_OUT.

Discussed below is the case in which noise is applied to the clock lane at time tA before the transmission of the data message HS_DATA(2) is completed, and accordingly the CLK_LP circuit 1 incorrectly determines that the clock lane is switched to the LP mode. In this case, the CLK_LP circuit 1 negates the HS mode signal CLK_HS_mode at time tA. The negation of the HS mode signal CLK_HS_mode causes a halt of the generation of the clock signal HS_CLK_OUT, resulting in the unsuccessful transmission of the data message HS_DATA(2).

After the transmitting side (that is, the host 110) then completes the transmission of the data message HS_DATA (2), an LP-mode transition command is transmitted over data lane 0 with the data signals DATA0_P and DATA0_N at time t5. When detecting from the data signals DATA0_P and DATA0_N that the LP-mode transition command is transmitted over data lane 0, the DATA_LP circuit 3 negates the HS mode signal DATA0_HS_mode to switch data lane 0 to the LP mode.

In response to the negation of the HS mode signal DATA0_HS_mode, the malfunction detection circuit 5 determines the voltage level of the HS mode signal CLK_HS_mode. Since the HS mode signal CLK_HS_mode is negated at time t5 (that is, the CLK_LP circuit 1 and the CLK_HS circuit 2 operate in the LP mode at time t5), the malfunction detection circuit 5 determines that a malfunction occurs, and asserts the HS-mode return signal. The CLK_LP circuit 1 unconditionally asserts the HS mode signal CLK_HS_mode in response to the assertion of the HS-mode return signal to activate the CLK_HS circuit 2 at time tB. The CLK_HS circuit 2 restarts the generation of the clock signal HS_CLK_OUT in response to the assertion of the HS mode signal CLK_HS_mode. For example, the CLK_LP circuit 1 asserts the HS mode signal CLK_HS_ mode at the moment when the HS-mode return signal is negated after a predetermined time duration has elapsed after the assertion of the HS-mode return signal in the operation illustrated in FIG. 5; it should be noted however that the assertion of the HS mode signal CLK_HS_mode still results from the assertion of the HS-mode return signal.

Transmission of the third data message HS_DATA(3) is then started at time t6. The transmission of the third data message HS_DATA(3) is achieved in the same procedure as the data message HS_DATA(1). First, an HS-mode transition command is transmitted over data lane 0 with the data signals DATA0_P and DATA0_N at time t6. When detecting from the data signals DATA0_P and DATA0_N that the HS-mode transition command is transmitted over data lane 0, the DATA_LP circuit 3 asserts the HS mode signal DATA0_HS_mode to activate the DATA_HS circuit 4. When being activated, the DATA_HS circuit 4 latches the data signals DATA0_P and DATA0_N in synchronization with the clock signal HS_CLK_OUT to generate the reception data signal HS_DATA0_OUT. The reception data signal HS_DATA0_OUT is thus generated to indicate the data message HS_DATA(3).

When the transmission of the data message HS_DATA(3) is completed, an LP-mode transition command is transmitted over data lane 0 with the data signals DATA0_P and DATA0_N at time t7. When detecting the LP-mode transmission command in the data signals DATA0_P and DATA0_N, the DATA_LP circuit 3 negates the HS mode signal DATA0_HS_mode to switch data lane 0 to the LP mode. This completes the transmission of the third data message HS_DATA(3).

Meanwhile, the malfunction detection circuit 5 determines the voltage level of the HS mode signal CLK_HS_mode in response to the negation of the HS mode signal DATA0_HS_mode. Since the HS mode signal CLK_HS_ mode is asserted at time t7 (that is, the CLK_LP circuit 1 and the CLK_HS circuit 2 operate in the HS mode at time t7), the malfunction detection circuit 5 determines that no malfunction occurs, not asserting the HS-mode return signal.

Transmission of the fourth data message HS_DATA(4) is then started from time t8 in the similar manner. When the transmission of the data message HS_DATA(4) is completed, an LP-mode transition command is transmitted over data lane 0 with the data signals DATA0_P and DATA0_N at time t9. When detecting that the LP-mode transmission command is transmitted over data lane 0, the DATA_LP circuit 3 negates the HS mode signal DATA0_HS_mode. Furthermore, the malfunction detection circuit 5 determines the voltage level of the HS mode signal CLK_HS_mode at time t9. Since the HS mode signal CLK_HS_mode is asserted at time t9 (that is, the CLK_LP circuit 1 and the CLK_HS circuit 2 operate in the HS mode at time t9), the malfunction detection circuit 5 determines that no malfunction occurs, and therefore does not assert the HS-mode return signal.

This is followed by transmitting an LP-mode transition command over the clock lane with the clock signals CLK_P and CLK_N at time t10. When detecting from the voltage levels on the two signal lines of the clock lane that the LP-mode transition command is transmitted, the CLK_LP circuit 1 negates the HS mode signal CLK_HS_mode at time t10. This results in that both of data lane 0 and the clock lane are switched to the LP mode, completing the data communications in the HS mode.

The above-described operation effectively reduces the failure of data communications in the hs mode to the minimum, even when the clock lane is incorrectly determined as being switched from the hs mode to the lp mode due to noise applied to the clock lane. Regarding the receiver circuit 100 illustrated in FIG. 1B, and as illustrated in FIG. 3, noise a applied in the transmission of the data message hs_data(2) causes the reception of the data message hs_data (2) to fail and further causes the reception of subsequent data messages hs_data(3) and hs_data(4) to fail. This results from the halt of the generation of the clock signal hs_clk_out. In contrast, the receiver circuit 10 of the present embodiment, which incorporates therein the malfunction detection circuit 5, successfully receives the subsequent data messages hs_data(3) and hs_data(4) even when noise A is applied in the transmission of the data message hs_data(2), although the receiver circuit 10 of the present embodiment fails to receive the data message hs_data(2). This is because the clk_lp circuit 1 and the clk_hs circuit 2 are returned to the HS mode and the generation of the clock signal hs_clk_out is restarted. As thus discussed, the operation of the receiver circuit 10 in the present embodiment effectively reduces an undesired influence of a malfunction caused by noise applied to the clock lane.

Figure 6:
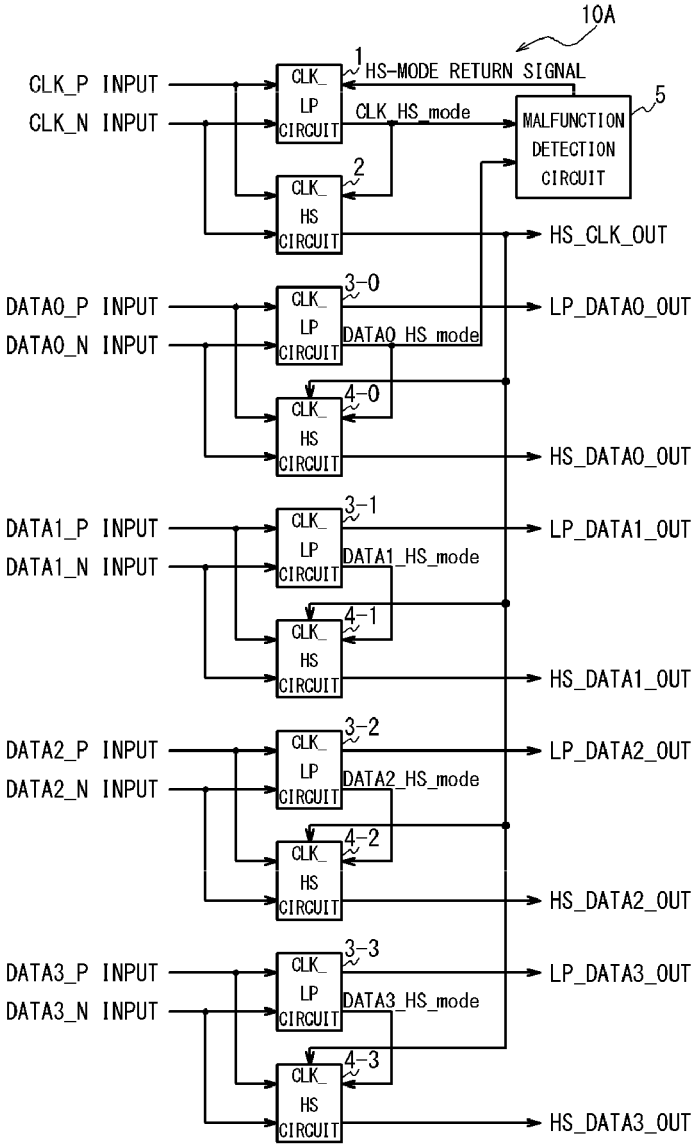
FIG. 6 is a block diagram illustrating one example of the configuration of a receiver circuit in the case when four data lanes are used for data communications.

It should be noted that, although FIG. 4 illustrates the configuration of the receiver circuit 10 for the case when one clock lane and one data lane (data lane 0) are used for communications in accordance with the MIPI-DSI standard, a plurality of data lanes may be used for data communications, as defined in the MIPI-DSI standard. FIG. 6 is a block diagram illustrating one example of the configuration of a receiver circuit (denoted by numeral 10A) in the case when four data lanes 0 to 3 are used for data communications.

When a plurality of data lanes are used, the receiver circuit 10A includes one DATA_LP circuit 3 and one DATA_HS circuit 4 for each data lane. In FIG. 6, numeral "3-*i*" denotes a DATA_LP circuit 3 corresponding to data lane i and numeral "4-*i*" denotes a DATA_HS circuit 4 corresponding to data lane i.

Each DATA_LP circuit 3-*i* receives data signals DATAi_P and DATAi_N and generates an HS mode signal DATAi_HS_mode and a reception data signal LP_DATAi_OUT in the similar manner as the above-described DATA_LP circuit 3. More specifically, When detecting that an HS-mode transition command is transmitted with the data signals DATAi_P and DATAi_N, (that is, the voltage levels on the two signal lines of data lane i are switched in the sequence corresponding to the HS-mode transition command), the DATA_LP circuit 3-*i* asserts the HS mode signal DATAi_HS_mode. When detecting that an LP-mode transition command is transmitted with the data signals DATAi_P and DATAi_N (that is, the voltage levels on the two signal lines of data lane i are switched in the sequence corresponding to the LP-mode transition command), the DATA_LP circuit 3-*i* negates the HS mode signal DATAi_HS_mode. It should be noted that four HS mode signals DATA0_HS_mode to DATA3_HS_mode are generated by four DATA_LP circuits 3-0 to 3-3 in this configuration.

When data lane i is set to the LP mode, each DATA_LP circuit 3-*i* performs a clock recovery on the data signals DATAi_P and DATAi_N to generate an internal clock signal. The DATA_LP circuit 3-*i* latches the data signals DATAi_P and DATAi_N in synchronization with the thus-generated internal clock signal to identify data transmitted with the data signals DATAi_P and DATAi_N, and generates a reception data signal LP_DATAi_OUT which indicates the identified data.

Each DATA_HS circuit 4-*i* receives data signals DATAi_P and DATAi_N and generates a reception data signal HS_DATAi_OUT in the similar manner as the above-described DATA_HS circuit 4. When data lane i is set to the HS mode, each DATA_HS circuit 4-*i* latches the data signals DATAi_P and DATAi_N in synchronization with the clock signal HS_CLK_OUT received from the CLK_HS circuit 2, to identify data transmitted with the data signals DATAi_P and DATAi_N. The DATA_HS circuit 4-*i* generates a reception data signal HS_DATAi_OUT corresponding to the identified data.

In one embodiment, the malfunction detection circuit 5 may determine the timing when occurrence of malfunction is to be checked, only in response to the HS mode signal DATA0_HS_mode, not referring to the HS mode signals DATA1_HS_mode to DATA3_HS_mode. In general, when a plurality of data lanes are available for a data communication in accordance with the MIPI-DSI standard, data lane 0 is necessarily used for the data communication, and the data lanes used for the data communication are switched between the LP mode and the HS mode substantially at the same time. Accordingly, it is sufficient to refer only to the HS mode signal DATA0_HS_mode, which is generated by the DATA_LP circuit 3-0 corresponding to data lane 0, for determining the timing when occurrence of malfunction is to be checked. In the configuration illustrated in FIG. 6, the malfunction detection circuit 5 determines the voltage level of the HS mode signal CLK_HS_mode in response to the negation of the HS mode signal DATA0_HS_mode. In the case when the HS mode signal CLK_HS_mode is negated at the moment when the HS mode signal DATA0_HS_mode is negated, the malfunction detection circuit 5 asserts the HS-mode return signal.

Figure 7A:
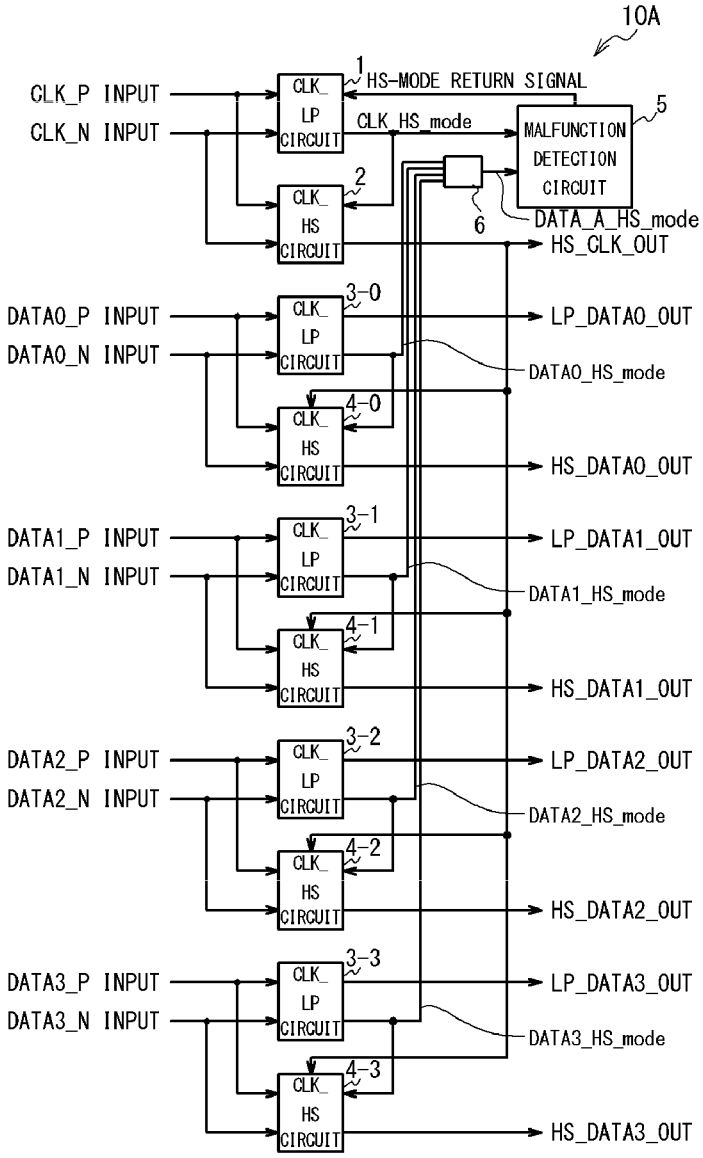
FIG. 7A is a block diagram illustrating another example of the configuration of the receiver circuit in the case when four data lanes are used for data communications.

In an alternative embodiment, the malfunction detection circuit 5 may check the voltage level of the HS mode signal CLK_HS_mode when at least one of data lanes used for the data communication is switched to the LP mode. FIG. 7A is a block diagram illustrating the configuration of the receiver circuit 10A which performs such an operation. The receiver circuit 10A illustrated in FIG. 7A further includes an HS mode detection circuit 6. The HS mode detection circuit 6 asserts an HS mode signal DATA_A_HS_mode when all of the data lanes being used for a data communication are placed in the HS mode, and negates the HS mode signal DATA_A_HS_mode when at least one of the data lanes being used for the data communication is placed in the LP mode.

Figure 7B:
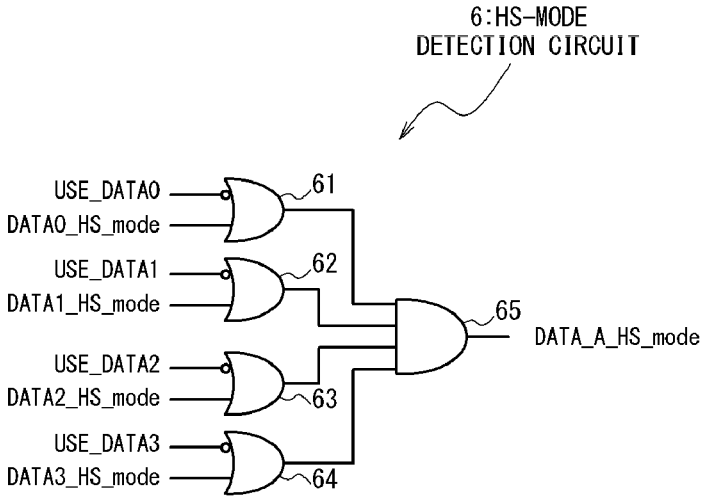
FIG. 7B is a circuit diagram illustrating an example of the configuration of the HS mode detection circuit in the receiver circuit illustrated in FIG. 7A.

FIG. 7B is a circuit diagram illustrating an example of the configuration of the HS mode detection circuit 6. The HS mode detection circuit 6 includes OR gates 61 to 64 and an AND gate 65. The HS mode detection circuit 6 receives the HS mode signals DATA0_HS_mode to DATA3_HS_mode and lane in-use signals USE_DATA0 to USE_DATA3. Here, the lane in-use signal USE_DATA0 is a signal which is asserted when data lane 0 is in use for a data communication, and is negated otherwise. Correspondingly, the lane in-use signal USE_DATA1 to USE_DATA3 are signals which are asserted when data lanes 1 to 3 are in use for a data communication, respectively, and are negated otherwise. The OR gate 61 outputs an output signal which indicates the logical sum of the HS mode signal DATA0_HS_mode and the inversion signal of the lane in-use signal USE_DATA0 and the OR gate 62 outputs an output signal which indicates the logical sum of the HS mode signal DATA1_HS_mode and the inversion signal of the lane in-use signal USE_DATA1. Correspondingly, the OR gate 63 outputs an output signal which indicates the logical sum of the HS mode signal DATA2_HS_mode and the inversion signal of the lane in-use signal USE_DATA2 and the OR gate 64 outputs an output signal which indicates the logical sum of the HS mode signal DATA3_HS_mode and the inversion signal of the lane in-use signal USE_DATA3. The AND gate 65 generates an output signal indicating the logical product of the output signals of the OR gates 61 to 64. The output signal of the AND gate 65 is fed to the malfunction detection circuit 5 as the HS mode signal DATA_A_HS_mode.

Referring back to FIG. 7A, when the HS mode signal CLK_HS_mode is negated at the moment when the HS mode signal DATA_A_HS_mode received from the HS mode detection circuit 6 is negated, that is, at the moment when at least one of the data lanes having been used for the data communication in the HS mode is switched to the LP mode, the malfunction detection circuit 5 asserts the HS-mode return signal.

Figure 8:
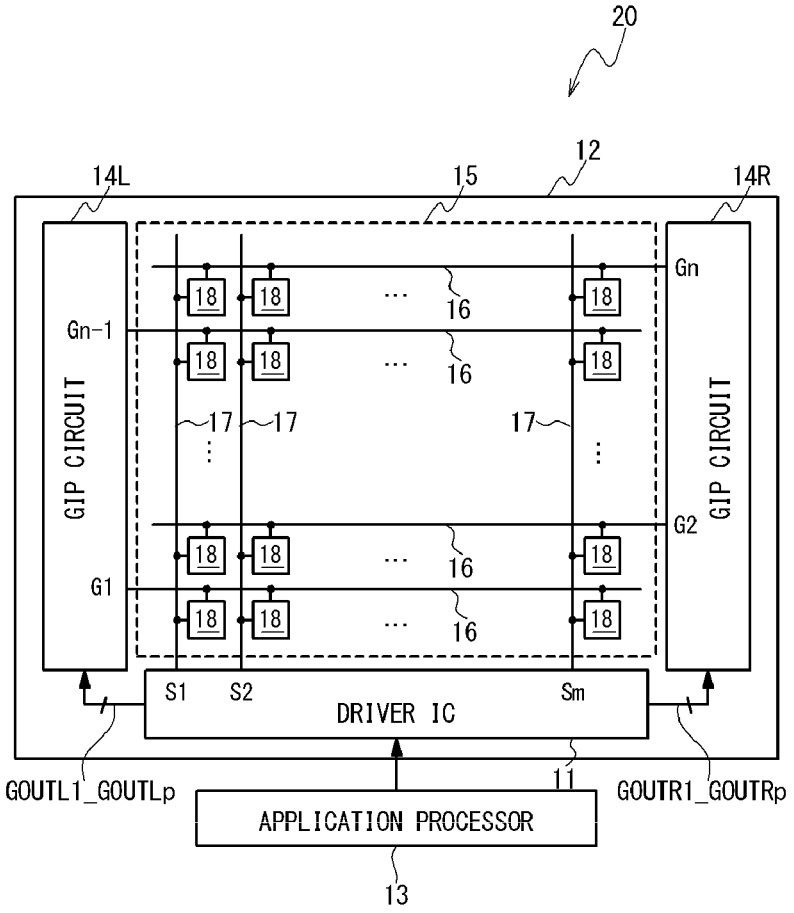
FIG. 8 is a block diagram illustrating one example of a liquid crystal display device including a driver IC (integrated circuit) which incorporates therein the receiver circuit of the present embodiment.
Figure 9:
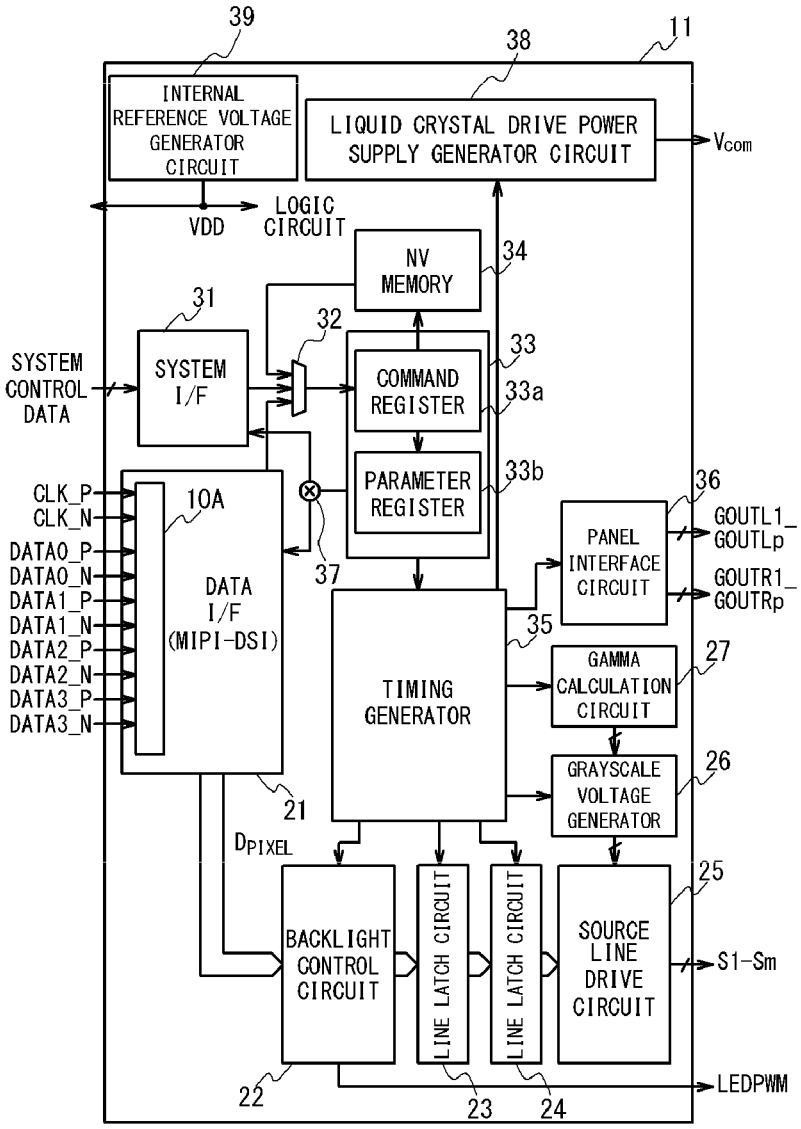
FIG. 9 is a block diagram illustrating one example of the configuration of a driver IC incorporating the receiver circuit of the present embodiment.

The above-described receiver circuits (10, 10A) of the present embodiment may be used as an interface which receives data from a processor (e.g. a CPU (central processing unit)) in a display panel driver of a panel display device. FIG. 8 is a block diagram illustrating one example of a liquid crystal display device 20 including a driver IC (integrated circuit) 11 which incorporates therein the receiver circuit (10, 10A) of the present embodiment, and FIG. 9 is a block diagram illustrating one example of the configuration of the driver IC 11.

Referring to FIG. 8, the liquid crystal display device 20 includes a liquid crystal display panel 12 in addition to the driver IC 11.

The liquid crystal display panel 12 includes a pair of GIP (gate in panel) circuit 14L, 14R and a display region 15. The GIP circuit 14L is located on the left of the display region 15 and the GIP circuit 14R is located on the right of the display region 15. A plurality of gate lines (also referred to as scan lines or address lines) 16 and a plurality of source lines (also referred to as signal lines or data lines) 17 are arranged in the display region 15 and a plurality of subpixels 18 are arrayed in rows and columns in the display region 15. Each subpixel 18 is configured to display one of the red color (R), green color (G) and blue color (B) and each pixel of the liquid crystal display panel 12 includes three subpixels 18 which respectively display the red color (R), green color (G) and blue color (B). The GIP circuit 14L drives odd-numbered gate lines 16 and the GIP circuit 14R drives even-numbered gate lines 16.

The driver IC 11 drives the source lines 17 in response to image data and control data received from an application processor 13. The image data, which are data corresponding to images to be displayed in the display region 15 of the liquid crystal display panel 12, indicate the grayscale levels of the respective subpixels 18.

In response to the control data received from the application processor 13, the driver IC 11 further generates gate control signals GOUTL1 to GOUTLp for controlling the GIP circuit 14L (p is an integer equal to or larger than two) and gate control signals GOUTR1 to GOUTRp for controlling the GIP circuit 14R. The driver IC 11 is mounted on the liquid crystal display panel 12 with a surface mounting technique such as a COG (chip on glass) technique.

FIG. 9 is a block diagram illustrating an example of the configuration of the driver IC 11. Overall, the driver IC 11 includes a data drive circuitry (21 to 27), a control circuitry for operation control (31 to 37) and a power system circuitry (38, 39).

The data drive circuitry, which is configured to generate source drive signals S1 to Sm which drive the source lines 17, includes a data interface 21, a backlight control circuit 22, line latch circuits 23, 24, a source drive circuit 25, a grayscale voltage generator circuit 26 and a gamma calculation circuit 27. These circuits of the data drive circuitry schematically operate as follows:

The data interface 21 externally receives image data corresponding to images to be displayed in the display region 15 of the liquid crystal display panel 12 from the application processor 13. The above-described receiver circuit of the present embodiment (10 or 10A) is used in the data interface 21. FIG. 9 illustrates the configuration in which the receiver circuit 10A illustrated in FIG. 6 is integrated in the data interface 21. When image data are transmitted from the application processor 13 to the driver IC 11, the image data are transmitted to the receiver circuit (10 or 10A) of the data interface 21 over data lanes 0 to 3 in the HS mode. The data interface 21 forwards the received image data $D_{PIXEL}$ to the backlight control circuit 22.

The data interface 21 also has the function of receiving commands used for controlling the driver IC 11 from an external device (that is, the application processor 13). The data interface 21 forwards the received commands to the control circuitry (31 to 37).

The backlight control circuit 22 generates a backlight brightness control signal LEDPWM which controls a backlight (not shown) illuminating the liquid crystal display panel 12 in response to the received image data $D_{PIXEL}$.

The line latch circuit 23 sequentially receives the image data $D_{PIXEL}$ from the backlight control circuit 22 and stores therein the received image data. The line latch circuit 23 is configured to store image data $D_{PIXEL}$ corresponding to subpixels 18 in one horizontal line (subpixels 18 connected to one gate line 16).

The line latch circuit 24 latches the image data $D_{PIXEL}$ stored in the line latch circuit 23 when each horizontal sync periods starts. In each horizontal sync period, the respective source lines 17 are driven in response to the image data $D_{PIXEL}$ latched by the line latch circuit 24 in the horizontal sync period.

The source drive circuit 25 generates the source drive signals S1 to Sm for respectively driving the source lines 17 in response to the image data $D_{PIXEL}$ received from the line latch circuit 24. Grayscale voltages received from the grayscale voltage generator circuit 26 are used for generating the source drive signals S1 to Sm.

The grayscale voltage generator circuit 26 generates grayscale voltages used in the source drive circuit 25 for generating the source drive signals S1 to Sm. The grayscale voltage generator circuit 26 generates the grayscale voltages from grayscale reference voltages received from the gamma calculation circuit 27.

The gamma calculation circuit 27 generates the grayscale reference voltages used in the grayscale voltage generator circuit 26 for generating the grayscale voltages so that a gamma correction with a desired gamma value is achieved. The voltage levels of the grayscale voltages generated by the grayscale voltage generator circuit 26 are controlled with the grayscale reference voltages generated by the gamma calculation circuit 27.

The control circuitry includes a system interface 31, a selector 32, a register circuit 33, a non-volatile memory 34, a timing generator 35, a panel interface circuit 36 and a switch 37. These circuits of the control circuitry schematically operate as follows:

The system interface 31 receives control data controlling the driver IC 11 from the application processor 13. The control data includes commands and parameters used in the control of the driver IC 11. The selector 32 selectively provides a connection to the register circuit 33 for any of the data interface 21, the system interface 31 and the non-volatile memory 34, to allow an access to the register circuit 33. The register circuit 33 includes a command register 33*a* and a parameter register 33*b*. The command register 33*a* holds commands externally received from an external device (in the present embodiment, the application processor 13). The parameter register 33*b* holds various register values used for controlling the driver IC 11. The non-volatile memory 34 stores therein register values which are to be set to the parameter register 33*b* and necessary to be held in a non-volatile manner.

The timing generator 35 performs timing control of the entire driver IC 11 in response to the commands held in the command register 33*a* and the register values held in the parameter register 33*b*. The panel interface circuit 36 is a control circuit which generates the gate control signals GOUTL1 to GOUTLp and GOUTR1 to GOUTRp fed to the GIP circuits 14L and 14R of the liquid crystal display panel 12. The switch 37 selectively outputs commands and parameters read from the register circuit 33 to the data interface 21 or the system interface 31. The data interface 21 or the system interface 31 which receives the commands and parameters externally transmits the received commands and parameters to the external device (in the present embodiment, the application processor 13).

The power system circuitry includes a liquid crystal drive power supply generator circuit 38 and an internal reference voltage generator circuit 39. The liquid crystal drive power supply generator circuit 38 externally receives an analog power supply voltage VCI and generates various power supply voltages used in the driver IC 11. The internal reference voltage generator circuit 39 includes a group of circuits which generates a logic power supply voltage VDD.

Although various embodiments of the present invention are specifically described in the above, the present invention should not be construed as being limited to the above-described embodiments; it would be apparent to a person skilled in the art that the present invention may be implemented with various modifications.

For example, although the above-described embodiments recite that the receiver circuit (10 or 10A) is used on the receiving side of a system which performs communications in accordance with the MIPI-DSI standard, the present invention is generally applicable to a system which performs communications in accordance with a communication standard similar to the MIPI-DSI standard (for example, other standards defined by the MIPI alliance, including MIPI D-PHY and MIPI CSI). In this case, a receiver circuit may include: a mode detection circuit detecting a transition of a communication mode of a clock lane from a clock signal received from the clock lane to generate a first mode signal indicating the communication mode of the clock lane; a clock generator circuit configured to generate an internal clock signal which is synchronous with the clock signal when the first mode signal is set to a state corresponding to a first communication mode and to halt the generation of the internal clock signal when the first mode signal is set to a state corresponding to a second communication mode; a first reception circuit configured to detect a transition of a communication mode of a data lane from a data signal received from the data lane, to generate a second mode signal indicating the communication mode of the data lane, and to generate a first reception data signal corresponding to data transmitted with the data signal when the second mode signal is set to a state corresponding to the second communication mode; a second reception circuit configured to, when the second mode signal is set to a state corresponding to the first communication mode, identify data transmitted with the data signal by latching the data signal in synchronization with the internal clock signal and to generate a second reception data signal corresponding to the identified data; and a malfunction detection circuit. The malfunction detection circuit asserts a first communication mode return signal when the first mode signal is set to the state corresponding to the second communication mode at a moment when the second mode signal is switched from the state corresponding to the first communication mode to the state corresponding to the second communication mode. The mode detection circuit sets the first mode signal to the state corresponding to the first communication mode in response to the assertion of the first communication mode return signal.

It will be understood that the receiver circuit thus configured has a corresponding configuration to the above-described receiver circuit 10 of the present embodiment, which is adapted to the MIPI-DSI standard, with an assumption that the first communication mode corresponds to the HS mode and the second communication mode corresponds to the LP mode.

It should be also noted that, although FIG. 7 illustrates one embodiment in which the liquid crystal display device 20 includes the liquid crystal display panel 12, the receiver circuit (10, 10A) of the present embodiment may be integrated in a display panel driver which drives a different kind of display panel (such as, OLED (organic light emitting diode) display panels and plasma display panels) in a display device.

In the first example, the invention can be described as a display device, comprising:

a display panel; and a display panel driver driving the display panel in response to externally-received image data, wherein the display panel driver includes:

a receiver circuit operating as a receiving side of a communication in accordance with the MIPI-DSI standard, wherein the receiver circuit includes:

a CLK_LP circuit detecting a transition of a communication mode of a clock lane from voltage levels on two signal lines of the clock lane to generate a first mode signal indicating the communication mode of the clock lane;

a CLK_HS circuit configured to generate an internal clock signal which is synchronous with a differential clock signal received from the clock lane when the first mode signal is set to a state corresponding to an HS "high speed" mode, and to halt the generation of the internal clock signal when the first mode signal is set to a state corresponding to the LP "low power" mode;

a DATA_LP circuit configured to detect a transition of a communication mode of a data lane from voltage levels on two signal lines of the data lane, to generate a second mode signal indicating the communication mode of the data lane, and to generate a first reception data signal corresponding to data transmitted with a differential data signal received from the data lane when the second mode signal is set to a state corresponding to the LP mode;

a DATA_HS circuit configured to, when the second mode signal is set to a state corresponding to the HS mode, identify data transmitted with the differential data signal by latching the differential data signal in synchronization with the internal clock signal and to generate a second reception data signal corresponding to the data transmitted with the differential data signal; and a malfunction detection circuit, wherein the image data are transmitted to the receiver circuit over the data lane, wherein the malfunction detection circuit asserts an HS-mode return signal when the first mode signal is set to the state corresponding to the LP mode at a moment when the second mode signal is switched from the state corresponding to the HS mode to the state corresponding to the LP mode, and wherein the CLK_LP circuit sets the first mode signal to the state corresponding to the HS mode in response to the assertion of the HS-mode return signal.

In the second example, the invention can be described as a method of operating a receiver circuit, comprising:

detecting a transition of a communication mode of a clock lane from a clock signal received from the clock lane to generate a first mode signal indicating the communication mode of the clock lane;

starting a generation of a first internal clock signal which is synchronous with the clock signal when the first mode signal is set to a state corresponding to a first communication mode;

halting the generation of the first internal clock signal when the first mode signal is set to a state corresponding to a second communication mode;

detecting a transition of a communication mode of a data lane from a data signal received from the data lane to generate a second mode signal indicating the communication mode of the data lane;

performing a clock recovery on the data signal to generate an second internal clock signal when the second mode signal is set to a state corresponding to the second communication mode;

identifying data transmitted with the data signal by latching the data signal in synchronization with the second internal clock when the second mode signal is set to the state corresponding to the second communication mode;

identifying data transmitted with the data signal by latching the data signal in synchronization with the first internal clock signal, when the second mode signal is set to a state corresponding to the first communication mode;

generating a reception data signal corresponding to the identified data; and placing the first mode signal into the state corresponding to the first communication mode, in a case when the first mode signal is set to the state corresponding to the second communication mode at a moment when the second mode signal is switched from the state corresponding to the first communication mode to the state corresponding to the second communication mode.

In the third example, the invention can be described as a method of operating a receiver circuit to be used on a receiving side of a communication in accordance with the MIPI-DSI standard, the method comprising:

detecting a transition of a communication mode of a clock lane from voltage levels on two signal lines of the clock lane to generate a first mode signal indicating the communication mode of the clock lane;

starting generation of a first internal clock signal which is synchronous with a differential clock signal received from the clock lane when the first mode signal is set to a state corresponding to an HS "high speed" mode;

halting the generation of the first internal clock signal when the first mode signal is set to a state corresponding to the LP "low power" mode;

detecting a transition of a communication mode of a data lane from voltage levels on two signal lines of the data lane, to generate a second mode signal indicating the communication mode of the data lane;

performing a clock recovery on a differential data signal received from the data lane to generate a second internal clock signal, when the second mode signal is set to a state corresponding to the LP mode;

identifying data transmitted with the differential data signal by latching the differential data signal in synchronization with the second internal clock signal, when the second mode signal is set to the state corresponding to the LP mode;

identifying data transmitted with the differential data signal by latching the differential data signal in synchronization with the first internal clock signal, when the second mode signal is set to the state corresponding to the HS mode;

generating a reception data signal corresponding to the identified data; and placing the first mode signal into the state corresponding to the HS mode, in a case when the first mode signal is set to the state corresponding to the LP mode at a moment when the second mode signal is switched from the state corresponding to the HS mode to the state corresponding to the LP mode.

These are just a few non-limiting of the examples describing the invention.

What is claimed is:

1. A receiver circuit comprising a clock lane and at least one data lane configured to update a display panel using received image data, the clock lane and the data lane each configured to operate in a respective communication mode selected from at least first and second communication modes, the receiver circuit comprising:

a mode detection circuit configured to generate, based on a first clock signal received from the clock lane, a first mode signal indicating the communication mode of the clock lane;

a first reception circuit configured to generate, based on a data signal received from the data lane, a second mode signal indicating the communication mode of the data lane, wherein the first communication mode represents a high speed mode of operation, and the second communication mode represents a low power mode of operation; and a malfunction detection circuit coupled with the mode detection circuit and the first reception circuit and configured to:

detect a transition of the data lane from the first communication mode to the second communication mode;

upon detecting the transition of the data lane to the second communication mode, determine the communication mode of the clock lane; and when the determined communication mode of the clock lane is the second communication mode, set the first mode signal to the first communication mode.

2. The receiver circuit of claim 1, wherein setting the first mode signal to the first communication mode includes asserting a communication mode return signal, wherein the mode detection circuit, upon receiving the asserted communication mode return signal, sets the first mode signal to the first communication mode.

3. The receiver circuit of claim 1, further comprising:

a clock generator circuit configured to generate an internal clock signal synchronous with the first clock signal when the first mode signal indicates that the clock lane is in the first communication mode.

4. The receiver circuit of claim 3, wherein the first reception circuit is further configured to generate, when the second mode signal indicates that the data lane is in the second communication mode, a first reception data signal corresponding to data included in the data signal, the receiver circuit further comprising a second reception circuit configured to:

when the second mode signal indicates that the data lane is in the first communication mode, identify data included in the data signal by latching the data signal in synchronization with the internal clock signal, and generate a second reception data signal corresponding to the identified data.

5. A method of operating a receiver circuit that includes a clock lane and at least a first data lane, the clock lane and the first data lane each operated in a respective communication mode selected from at least first and second communication modes, the method comprising:

generating, based on a first clock signal received from the clock lane, a first mode signal indicating the communication mode of the clock lane;

generating, based on a data signal received from the first data lane, a second mode signal indicating the communication mode of the data lane, wherein the first communication mode represents a high speed mode of operation, and the second communication mode represents a low power mode of operation;

detecting a transition of the first data lane from the first communication mode to the second communication mode;

upon detecting the transition of the first data lane to the second communication mode, determining the communication mode of the clock lane; and when the determined communication mode of the clock lane is the second communication mode, setting the first mode signal to the first communication mode.

6. The method of claim 5, wherein setting the first mode signal to the first communication mode includes asserting a communication mode return signal.

7. The method of claim 5, further comprising generating, when the first mode signal indicates that the clock lane is in the first communication mode, a first internal clock signal synchronous with the first clock signal.

8. The method of claim 7, further comprising:

identifying, when the second mode signal indicates that the first data lane is in the first communication mode, data included in the data signal by latching the data signal in synchronization with the first internal clock signal; and generating a reception data signal corresponding to the identified data.

9. The method of claim 7, further comprising:

generating, when the second mode signal indicates that the first data lane is in the second communication mode, a second internal clock signal by performing a clock recovery on the data signal;

identifying data included in the data signal by latching the data signal in synchronization with the second internal clock signal; and generating a reception data signal corresponding to the identified data.

10. A method of operating a receiver circuit on a receiving side of a communication in accordance with the mobile industry processor interface-display serial interface (MIPI-DSI) standard, the receiver circuit including a clock lane and at least a first data lane, the clock lane and the first data lane each operated in a respective communication mode selected from at least high speed (HS) and low power (LP) communication modes, the method comprising:

generating, based on a differential clock signal received from the clock lane, a first mode signal indicating the communication mode of the clock lane;

generating, based on a differential data signal received from the first data lane, a second mode signal indicating the communication mode of the first data lane;

detecting a transition of the first data lane from the HS mode to the LP mode;

upon detecting the transition of the first data lane to the LP mode, determining the communication mode of the clock lane; and when the determined communication mode of the clock lane is the LP mode, setting the first mode signal to the HS mode.

11. The method of claim 10, wherein setting the first mode signal to the HS mode includes asserting a communication mode return signal.

12. The method of claim 10, further comprising generating, when the first mode signal indicates that the clock lane is in the HS mode, a first internal clock signal synchronous with the differential clock signal.

13. The method of claim 12, further comprising:

identifying, when the second mode signal indicates that the first data lane is in the HS mode, data included in the data signal by latching the data signal in synchronization with the first internal clock signal; and generating a reception data signal corresponding to the identified data.

14. The method of claim 12, further comprising:

generating, when the second mode signal indicates that the first data lane is in the LP mode, a second internal clock signal by performing a clock recovery on the data signal;

identifying data included in the data signal by latching the data signal in synchronization with the second internal clock signal; and generating a reception data signal corresponding to the identified data.

* * * * *